US010029470B2

(12) United States Patent
Kerpe

(10) Patent No.: US 10,029,470 B2
(45) Date of Patent: Jul. 24, 2018

(54) INK-JET PRINTER WITH WIPER ASSEMBLY

(71) Applicant: Dover Europe Sàrl, Vernier (CH)

(72) Inventor: Sven Kerpe, Linkenheim-Hochstetten (DE)

(73) Assignee: Dover Europe Sàrl, Vernier (CH)

( * ) Notice: Subject to any disclaimer, the term of this patent is extended or adjusted under 35 U.S.C. 154(b) by 0 days.

(21) Appl. No.: 15/782,911

(22) Filed: Oct. 13, 2017

(65) Prior Publication Data

US 2018/0093479 A1 Apr. 5, 2018

Related U.S. Application Data

(62) Division of application No. 14/959,291, filed on Dec. 4, 2015, now Pat. No. 9,878,544.

(60) Provisional application No. 62/088,039, filed on Dec. 5, 2014.

(51) Int. Cl.
*B41J 2/165* (2006.01)

(52) U.S. Cl.
CPC ..... *B41J 2/16526* (2013.01); *B41J 2/16538* (2013.01); *B41J 2/16541* (2013.01); *B41J 2/16552* (2013.01); *B41J 2/16588* (2013.01)

(58) Field of Classification Search
CPC ..... B41J 2/16526; B41J 2/16588; B41J 2/16541; B41J 2/16552; B41J 2/16358
See application file for complete search history.

(56) References Cited

U.S. PATENT DOCUMENTS 5,905,514 A * 5/1999 Rhoads ..... B41J 2/16552 347/31
6,585,347 B1 7/2003 Johnson
2003/0227508 A1 12/2003 Chang
2014/0340447 A1 11/2014 Ito
2015/0273836 A1 10/2015 Akuta

FOREIGN PATENT DOCUMENTS

WO 2012/089182 7/2012

* cited by examiner

*Primary Examiner* — Bradley Thies
(74) *Attorney, Agent, or Firm* — Occhiuti & Rohlicek LLP

(57) ABSTRACT

An ink-jet printer with a print assembly includes an ink jet print head, the print assembly configured to be movable between a first position in which print head is positioned over a substrate to be printed upon and a second position in which the print head is positioned away from the substrate. The print head purges ink at the second position. A wiper assembly is positioned between the first position and the second position of the print assembly. The wiper assembly has a first orientation in which the wiper assembly does not contact the print head when the print assembly moves between the first position and the second position. The wiper assembly has a second orientation in which the wiper assembly contacts the print head when the print assembly moves between the second position and the first position. A fluid distribution device provides fluid to clean the wiper assembly.

12 Claims, 8 Drawing Sheets

INK-JET PRINTER WITH WIPER ASSEMBLY

CROSS REFERENCE TO RELATED APPLICATION

This application is a divisional of U.S. application Ser. No. 14/959,291, filed on Dec. 4, 2015 which claims priority to U.S. Provisional Application No. 62/088,039 filed on Dec. 5, 2014, the contents of which are hereby incorporated by reference in their entirety.

BACKGROUND

This invention relates to an ink jet printer having ink jet print heads that eject drops of ink onto substrates, such as paper or plastic, to form an image. Conventional ink jet print heads have multiple jets or nozzles, generally configured in an array. Each of the nozzles is in fluid communication with a chamber or reservoir that stores the ink to be jetted. In general, the ink jet print heads are spaced from the surface of the media on which the image is being produced. Because the print head and surface media are not in direct contact with each other, printing was made easier, cleaner and at a lower cost.

Nevertheless, dust, excess ink, and other debris can collect on a print head and degrade its performance. To remedy this problem, it is desirable to clean the ink jet print heads to remove the ink and debris, and restore its performance.

SUMMARY

In a general aspect, an ink-jet printer with a print assembly includes an ink jet print head, the print assembly configured to be movable between a first position in which the ink jet print head is positioned over a substrate to be printed upon and a second position in which the ink jet print head is positioned away from the substrate. The print head is configured to purge ink at the second position. The ink-jet printer includes a wiper assembly positioned between the first position and the second position of the print assembly. The wiper assembly has a first orientation in which the wiper assembly does not contact the print head when the print assembly moves between the first position and the second position. The wiper assembly has a second orientation in which the wiper assembly contacts the print head when the print assembly moves between the second position and the first position. A fluid distribution device is positioned to provide fluid to clean the wiper assembly.

Certain embodiments of this aspect of the invention may include one or more of the following features. The ink-jet printer includes a print assembly that moves along a first axis extending from the first position to the second position. The ink-jet printer includes a fluid distribution device that provides fluid to clean the wiper assembly. The ink-jet printer includes a fluid distribution device positioned to provide fluid to the wiper assembly along a second axis substantially transverse to the first axis. The ink-jet printer includes a fluid distribution device positioned to use gravity to provide fluid to the wiper assembly. The ink-jet printer includes a wiper assembly that is cleaned twice before it contacts the print head. The ink-jet printer includes a wiper assembly that is cleaned before it contacts the print head. The ink-jet printer includes a wiper assembly that is cleaned after it contacts the print head. The ink-jet printer of includes a wiper assembly that is cleaned while the print head is printing on the substrate. The ink-jet printer includes a fluid distribution device positioned to provide fluid to clean one or more wiper assemblies. The ink-jet printer includes a wiper assembly for each print head.

In another aspect of the invention, a method of providing maintenance to an ink jet print head includes providing an ink jet print head for ejecting ink onto a substrate, providing a wiper assembly for wiping the ink jet print head, and providing a set of control electronics for controlling the relative velocity between the wiper assembly and the ink jet print head.

In another aspect of the invention, a method of providing a maintenance cycle for an ink jet printer that contains at least one print head and a wiper configured to contact the print head in the vertical position and not contact the print head in the tilted position. The print head and the print assembly are moveable relative to each other between a printing position and a maintenance position. The maintenance cycle includes the following steps.

The wiper assembly is positioned between the printing position and the maintenance position of the print assembly. A fluid distribution device is attached to the print assembly and positioned over the wiper assembly when the print assembly is in the printing position. A flushing fluid is dispensed by the fluid distribution device onto the wiper to clean the wiper of excess ink and debris. The wiper is pivoted to a vertical position when the print head is printing upon a substrate. Flushing fluid is dispensed from the fluid distribution device onto the wiper to clean the wiper. The wiper is pivoted to a tilted position and the print assembly is moved from the printing position to the maintenance position and the print head is purged. The wiper is then pivoted to a vertical position, the print assembly is moved from the maintenance position to the printing position, and the wiper contacts the print head and excess ink and debris is removed from the print head. Flushing fluid is dispensed from the fluid distribution device onto the wiper to clean the wiper and the wiper is ten pivoted to a tilted position.

One advantage is that it is not necessary to move the print assembly to a special wiper cleaning position. Another advantage is there is no maintenance required by the operator to the wiper assembly during normal operation of the ink jet printer. Yet another advantage is that the flushing fluid that has contacted the wiper and may contain debris and excess ink, flows away from the edge of the wiper that will be in contact with the print head.

These general and specific aspects may be implemented using a system, a method, or a computer program, or any combination of systems, methods, and computer programs.

Other features and advantages of the invention are apparent from the following description, and from the claims.

DETAILED DESCRIPTION

Figure 1:
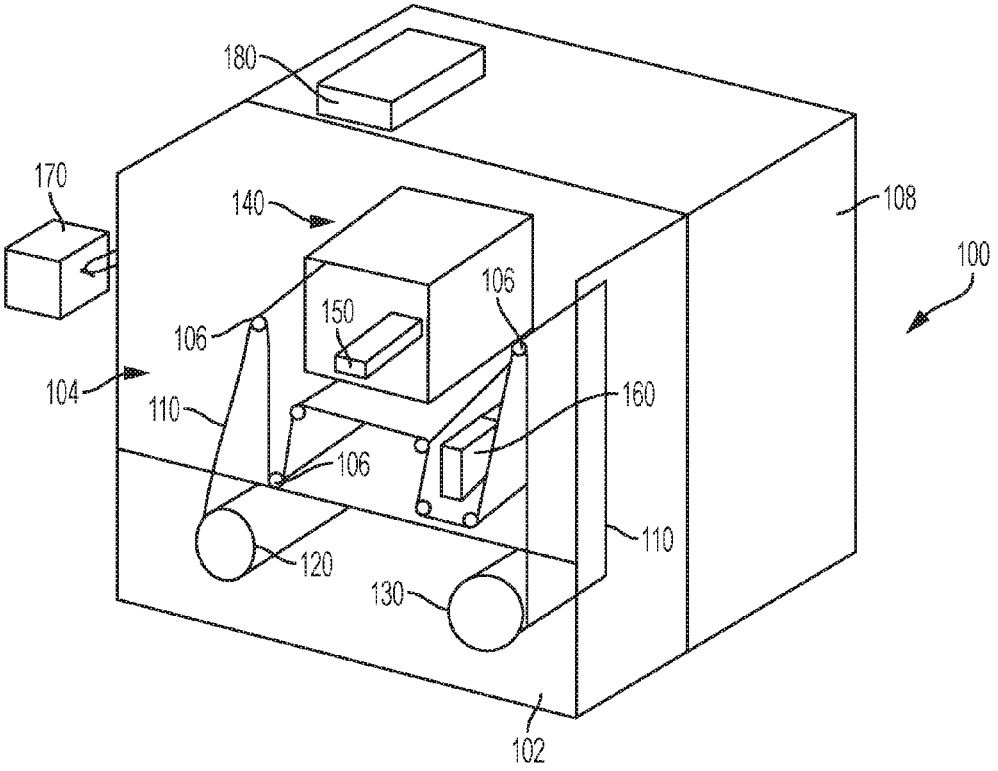
FIG. 1 is a perspective, somewhat schematic view of an ink-jet printer.
Figure 2:
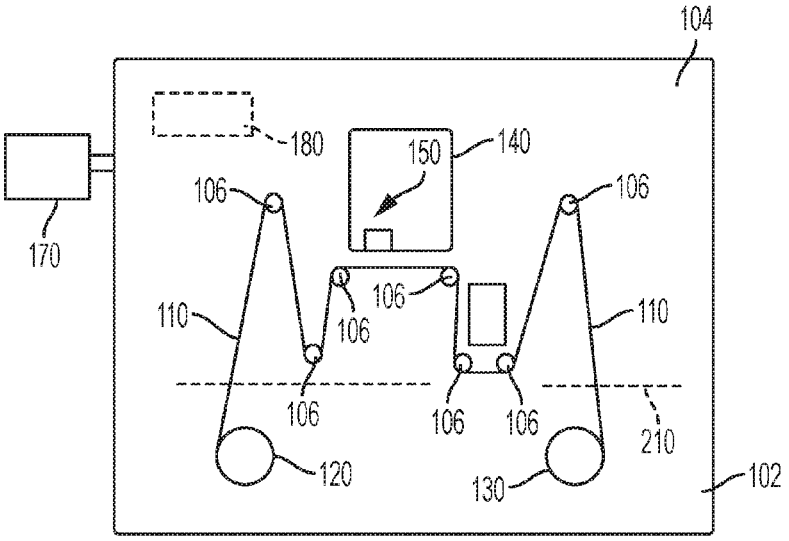
FIG. 2 is a front, schematic view of the ink-jet printer of FIG. 1.

Referring to FIGS. 1 and 2, a roll-to-roll web-based printer 100 is shown having a lower section 102 for housing an input roll 120 and an output roll 130. An upper front section 104 includes a print assembly 140 and a series of rollers 106 through which a substrate 110, spooled on input roll 120, winds its way continuously through the printer 100 until it reaches output roll 130. A dashed line 210 (FIG. 2) represents the boundary between lower section 102 and upper section 104. Print assembly 140 can include one or more print heads 150 (only one print head 150 is shown). Print head 150 is configured to jet ultraviolet ink onto substrate 110. Ultraviolet (UV) inks react to ultraviolet light and cure on substrate 110 when substrate 110 is exposed to ultraviolet light. Thus, upper section 104 also houses a UV light source 160 such that after substrate 110 passes under print assembly 140 and is printed on by print head 150 (discussed in greater detail below), substrate 110 passes by UV light source 160 before reaching output roll 130. Printer 100 also includes a rear section 108 for housing, among other parts, a set of control electronics 180, and a power supply (not shown). The set of control electronics 180 may in some embodiments not all be in one location. Print jobs are programmed through user interface 170. Rear section 108 also includes an open section for receiving print assembly 140, which is moveable from upper section 104, for example, when print assembly 140 requires cleaning or maintenance.

In some embodiments, more rollers 106 and sometimes an active guide system (not shown) are required to accurately guide substrate 110 under print assembly 140 and onto output roll 130. Also, sometimes "pinning" of the UV ink between colors on substrate 110 is required if more than one color is to be printed. The pinning process is done with UV light (not shown) and causes the UV ink to increase in viscosity, but does not fully cure the UV ink. Fully curing or "drying" the UV ink occurs when the substrate 110 passes by UV light source 160.

The printer 100 is designed such that no operator intervention within the printer is required during printing or maintenance of the ink jet print heads 150. This is accomplished by the set of control electronics 180 controlling some or all the aspects of printing and maintenance.

The inks used with ink jet print heads 150 can be one or more colors. In certain embodiments, printer 100 can be a Markem-Imaje CSAT ITS6 available from Markem-Imaje CSAT, Eggenstein-Leopoldshafen, Germany, which uses four colors of UV ink (cyan, magenta, yellow, and black). The Markem-Imaje CSAT ITS6 uses one or two Kyocera ink jet print heads per color, model KJ4A-TA06ATB-MR1V-4B available from Kyocera Corporation, Kyoto, Japan.

Figure 3A:
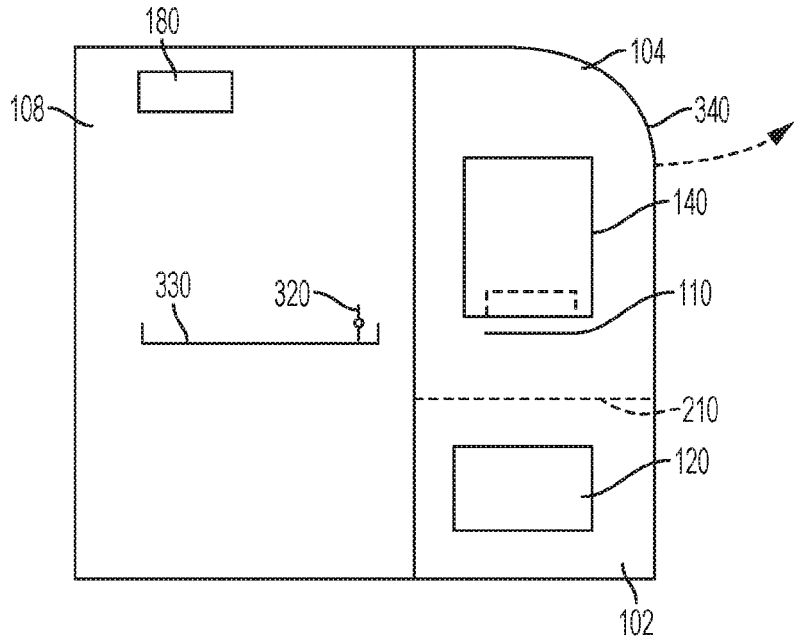
FIG. 3A is a side, schematic view of the ink-jet printer of FIG. 1 in a printing mode.

Referring to FIG. 3A, print assembly 140 is positioned within the upper front section 104 and in a printing position in which the print assembly 140 is positioned over substrate 110 that is to be printed upon.

Figure 3B:
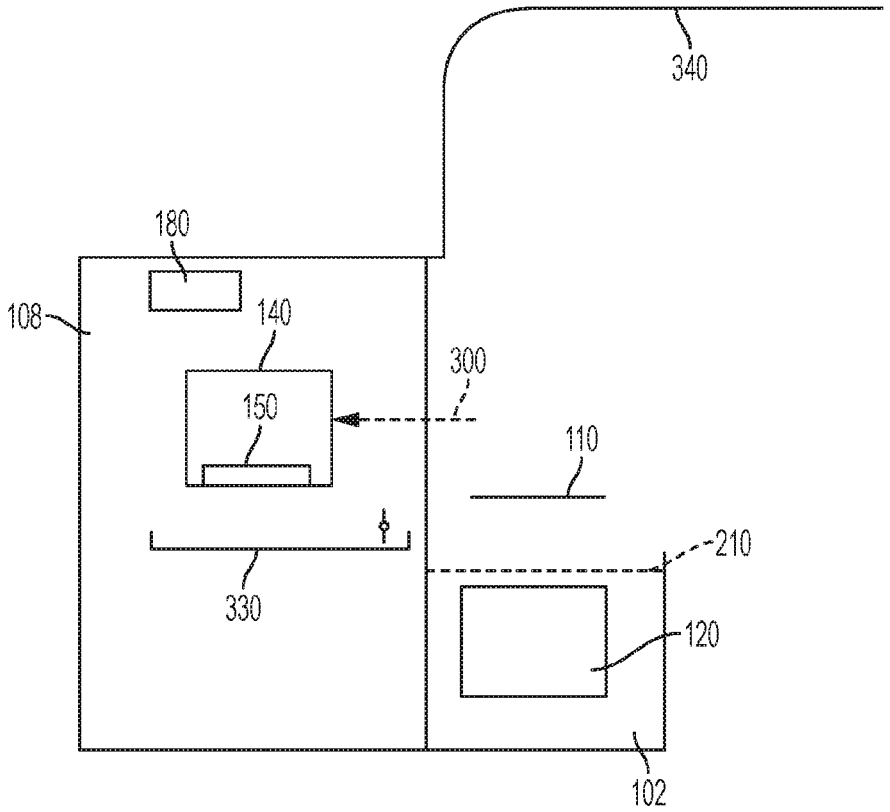
FIG. 3B is a side, schematic view of the ink-jet printer of FIG. 1 in a maintenance mode.

Referring to FIG. 3B, print assembly 140 can be moved along an axis 300 from a printing position in the upper front section 104 to a maintenance position in rear section 108 where the print assembly 140 and, more particularly, ink-jet print heads 150 are positioned over a stationary catch tray 330. In the maintenance position, print assembly 140 is moved away from substrate 110 and completely over catch tray 330. Cover 340 is in the open position to allow access to substrate 110.

As will be described in greater detail below in conjunction with FIGS. 7A-7I, ink-jet print heads 150 are cleaned when the print assembly is moved from the printing position in the upper front section 104 to the maintenance position in rear section 108. However, before embarking on a detailed description of the manner in which the ink-jet print heads 150 are cleaned, a discussion relating to the details of the print assembly 140 is appropriate.

Figure 4:
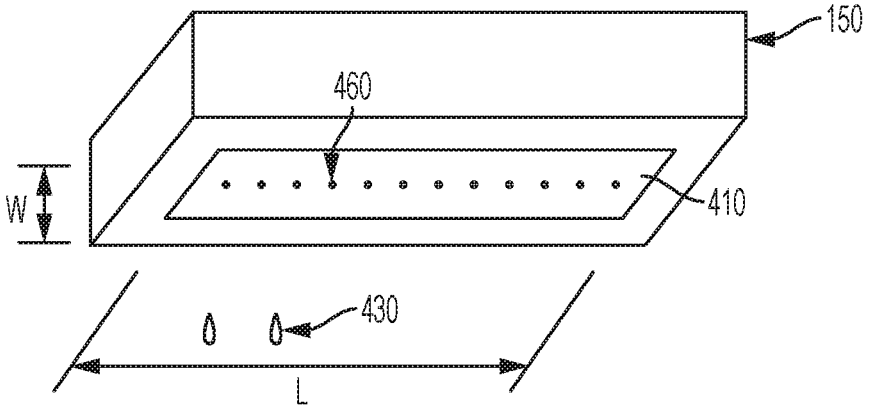
FIG. 4 is a perspective, schematic view of an ink jet print head for use in the ink-jet printer of FIG. 1.

Referring to FIG. 4, a print assembly 140 includes a print head 150 with at least one row of nozzles 460 for ejecting ink drops 430. Ink is dispensed from open ends of nozzles 460 at a front face 410 having a width (W) and a length (L). During printing, excess ink, substrate dust, or other debris may become attached to the face 410 of the print head 150. If the debris accumulates on or near a nozzle 460, ink drops 430 from the nozzle 460 may be misdirected and land at an undesired location on substrate 110. Misdirected ink drops can affect the quality of the image on the substrate 110; therefore, it is generally desired that the debris be removed. Thus, debris is generally removed during maintenance of the print head 150.

One approach for removing debris from print head 150 is to force a liquid out of every one of its nozzles 460 and then apply a wiper 320 (i.e., squeegee) to the front face 410 of the print head 150 to remove excess ink and any debris that may be on front face 410. Specifically, wiper 320 is passed down the length (L) of the front face 410 of print head 150 from one end to the opposite end of front face 410. The liquid forced out of nozzles 460 may be a special fluid or it may be the ink that is being used for printing on substrate 110. Forcing fluid out of every nozzle 460 of print head 150 is often referred to as "purging."

The wiper 320 is passed down the length (L) of front face 410 in one pass. The wiper 320 is in contact with the front face 410 over the full width (W) of the front face 410. In embodiments in which there are multiple print heads, a wiper 320 can be provided for each print head 150 in printer 100, or the same wiper 320 can be used to clean each of the multiple print heads 150.

In order to prevent debris on the wiper 320 from entering a nozzle 460, it is highly desirable that the top edge of wiper 320 be clean and free of debris before being brought into contact with the front face 410 of print head 150. Also, after contact with front face 410 of print head 150 is complete, wiper 320 may be cleaned again as part of the maintenance cycle to remove any debris and any ink before the ink has a chance to harden on wiper 320.

Figure 5:
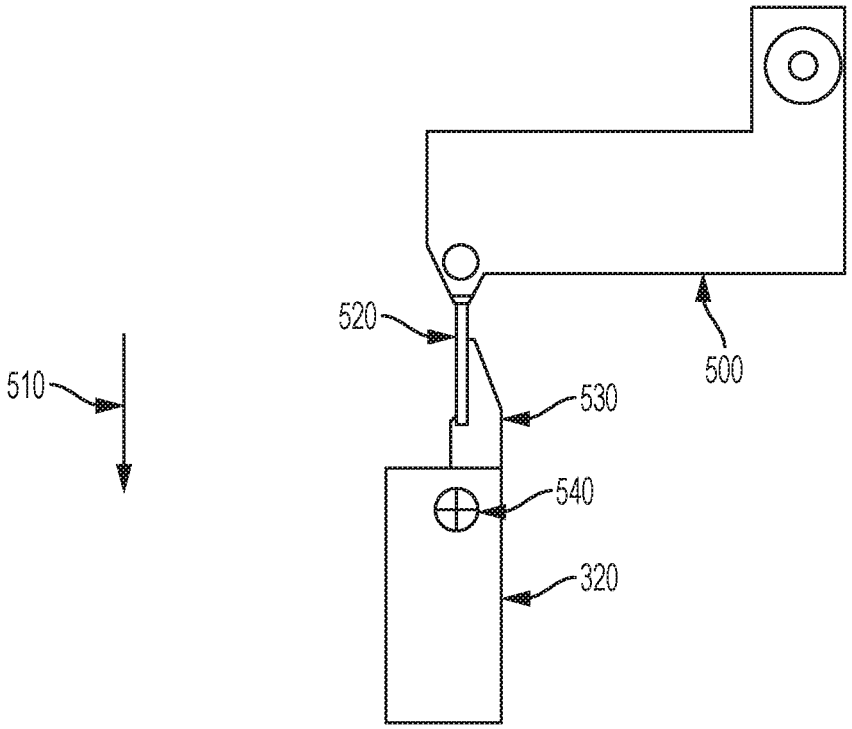
FIG. 5 is a side view of a fluid distribution device in position to clean a wiper.

Referring to FIG. 5, printer 100 includes a fluid distribution device 500, positioned above wiper 320. Flushing fluid 720 (FIG. 7B) comes out of fluid distribution device 500 and is allowed to shower and clean the wiper 320. Gravitational force, acting in the direction of arrow 510, causes the flushing fluid 720 and any debris or ink on wiper 320 to fall into catch tray 330.

To clean wiper 320, the fluid distribution device 500 showers wiper 320 with 0.1 to 20 cubic centimeters (cc's) of flushing fluid 720. It may dispense 4 cc's during a normal cleaning. It may dispense more or less during cleanings at other times. For example, more flushing fluid 720 may be used to clean wiper 320 when printer 100 is turned on and before printing. The set of control electronics 180 determines how much flushing fluid 720 is used each time to clean wiper 320.

The wiper 320 consists of a compliant wiper blade 520 that is positioned within a blade mount 530 that pivots about a pivot point 540. The wiper blade 520 is compliant and deforms when used as a squeegee against the front face 410 of print head 150. When not wiping the front face 410, the wiper blade 520 returns to its original shape. The wiper blade 520 can be made of Kalrez available from E. I. du Pont de Nemours & Company, Wilmington, Del. Alternatively, wiper blade 520 is a polymer, a rubber, or other compliant material.

Figure 6:
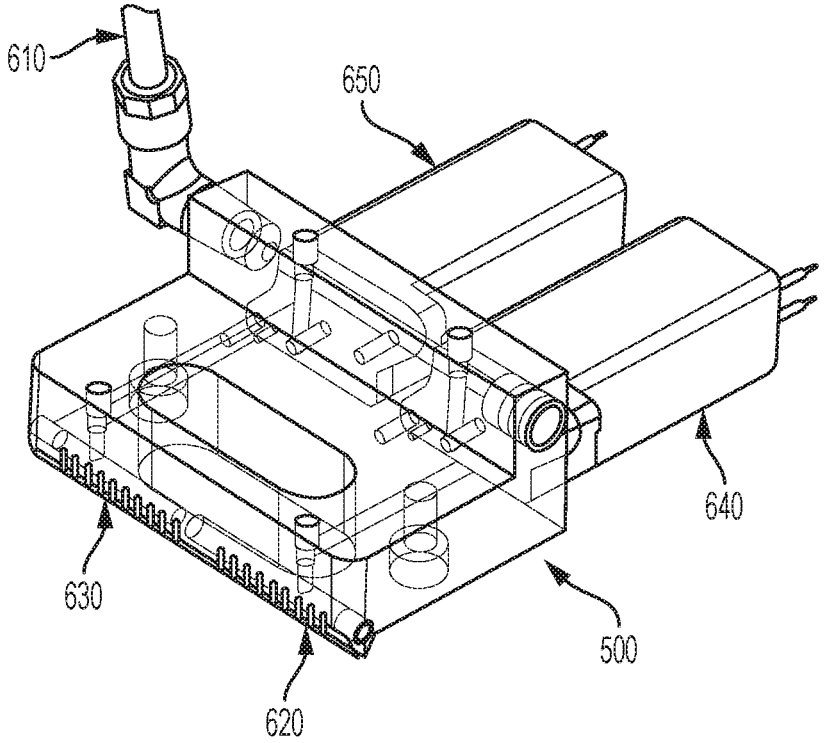
FIG. 6 is a perspective, schematic view of the fluid distribution device in FIG. 5.

Referring to FIG. 6, fluid distribution device 500 provides flushing fluid 720 to wiper 320. In this embodiment, a pair of wipers 320, for example, to clean a pair of print heads, can be showered with flushing fluid 720. Flushing fluid 720 is provided to an inlet 610 of the fluid distribution device. The flushing fluid 720 is supplied by a pump (not shown) that has a flow capacity to clean one wiper 320 at a time. Alternatively, gravity could supply the flushing fluid 720 to the inlet 610 of fluid distribution device 500, or a pump that has a flow capacity to clean multiple wipers 320 could be used. An example of a flushing fluid 720 suitable for use with cleaning wiper 320 is CSAT ITS6 G1/G2 Cleaning Fluid available from Markem-Imaje CSAT, Eggenstein-Leopoldshafen, Germany. A pair of solenoid valves 640, 650 is used to control the flow of flushing fluid 720 between inlet 610 and an array of outlet holes 620, 630 of the fluid distribution device 500. In this embodiment, outlet holes 620, 630 are each configured as a single row with the row long enough to shower an entire wiper 320. There are 9 holes, 0.7 millimeter in diameter, in each row of outlet holes, 620, 630 with the pressure at the inlet 610 at 0.5 bar. When solenoid valve 640 is open, flushing fluid moves from inlet 610 and exits through outlet holes 620. Similarly, when solenoid valve 650 is open, flushing fluid moves from the inlet 610 and exits through outlet holes 630. In another embodiment, if gravity is used as the force to dispense flushing fluid 720, the outlet holes 620, 630 may be a different number and a different diameter.

Figure 7A:
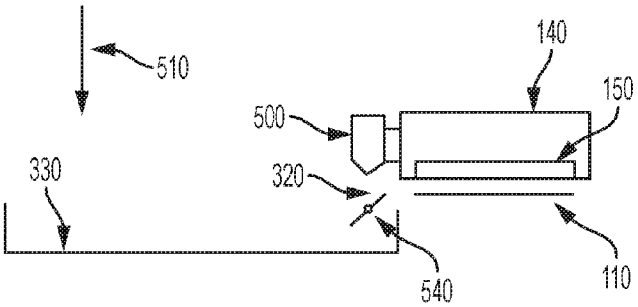
FIGS. 7A-7I are schematic, side views illustrating a process for cleaning an ink jet print head of the type shown in FIG. 4.
Figure 7B:
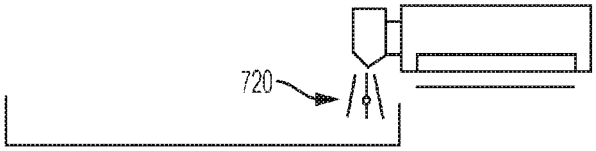

Referring to FIGS. 7A-7I, the steps in a maintenance cycle of print head 150 are shown schematically. Referring to FIG. 7A, a fluid distribution device 500 is shown attached to the print assembly 140. The print assembly 140 is positioned within the upper front section 104 and in a printing position so that print heads 150 can print on substrate 110. Wiper 320 is positioned with its pivot point 540 over catch tray 330. Wiper 320 is pivoted away from vertical into a tilted position. Referring to FIG. 7B, while print assembly 140 is still in position to allow print heads 150 to print on substrate 110, wiper 320 is pivoted into a vertical position under fluid distribution device 500. Fluid distribution device 500 is activated to shower wiper 320 with flushing fluid 720 to clean wiper 320. Flushing fluid 720 passing over wiper blade 320 as well as any debris falls into catch tray 330.

Figure 7C:
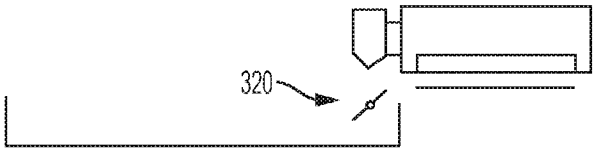

Referring to FIG. 7C, when fluid distribution device 500 is deactivated so that showering the wiper 320 with flushing fluid 720 is completed, the wiper 320 is pivoted away from its vertical position and back to its tilted position. Print assembly 140 is still in position so that print heads 150 can print on substrate 110.

Figure 7D:
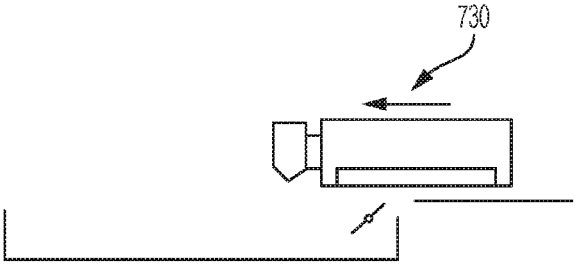

Referring to FIG. 7D, with the wiper blade 320 in its tilted position so as not to contact print head 150, print assembly 140 is then moved in the direction of arrow 730, along axis 300, from the upper front section 104 to the rear section 108.

Figure 7E:
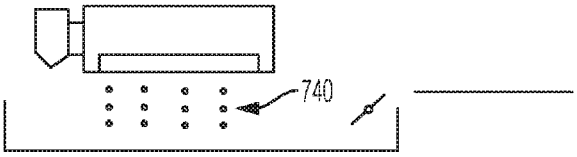

Referring to FIG. 7E, moved to rear section 108, print assembly 140 as well as print heads 150 are completely over catch tray 330 and print assembly 140 is no longer above substrate 110. Print assembly 140 is now in the maintenance position. Print head 150 is operated in a purge mode so that ink 740 is forced out of every nozzle 460 of the print head 150.

Figure 7F:
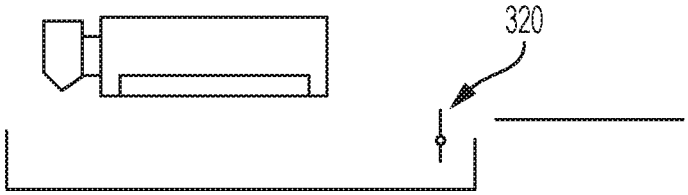

Referring to FIG. 7F, when the purge mode has been completed, wiper 320 is then pivoted back to its vertical position.

Figure 7G:
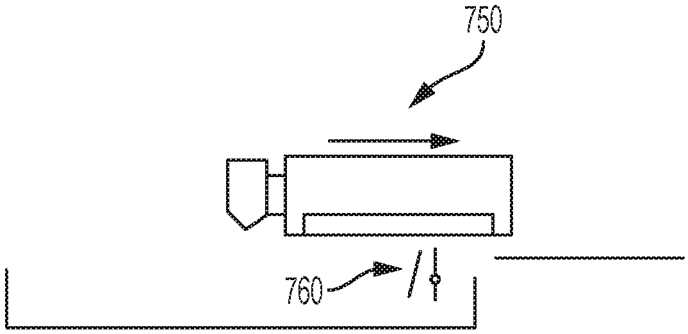

Referring to FIG. 7G, the print assembly 140 with print head 150 moves back along axis 300 in the direction of the arrow 750. The relative velocity of the print assembly past the wiper can be 1 to 5 meters/minute. In this embodiment the relative velocity is 2.5 meters/minute. With wiper 320 in its vertical position, the wiper contacts the face 410 of print head 150 and as the print head moves past the stationary wiper blade 520, ink and debris 760 is removed by the squeegee action of wiper 320 and falls into catch tray 330.

Figure 7H:
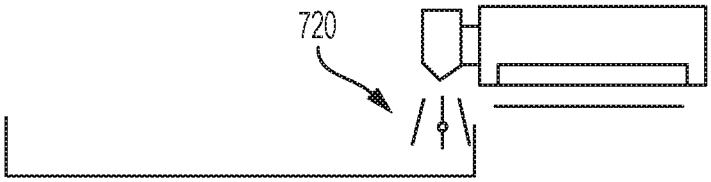

Referring to FIG. 7H, the print assembly 140 has moved from rear section 108 back to upper front section 104 and is in position so that print heads 150 can print on substrate 110. With wiper 320 in its vertical position and under fluid distribution device 500, the fluid distribution device 500 is activated to shower wiper 320 with flushing fluid 720 to clean wiper 320. As was the case described above in conjunction with FIG. 7B, flushing fluid 720 passing over wiper blade 320 as well as any debris or ink falls into catch tray 330.

Figure 7I:
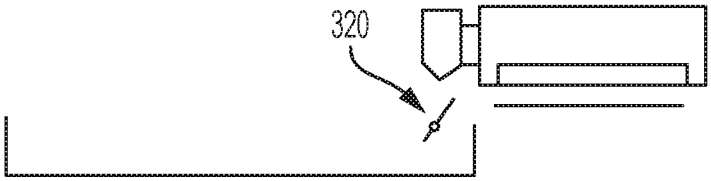

Referring to FIG. 7I, the fluid distribution device 500 has stopped showering the wiper 320 with flushing fluid 720, and the wiper 320 is pivoted away from vertical to a tilted position. Print assembly 140 is in position so that print heads 150 can print on substrate 110.

As shown in FIGS. 7A-7I, during a maintenance cycle, the wiper 320 can be cleaned before contacting the front face 410 of print head 150, and cleaned again after contact with the front face 410 has ceased. This removes any excess ink or debris on wiper 320.

Figure 8A:
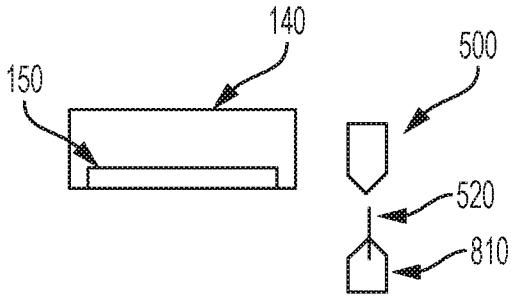
FIGS. 8A and 8B are schematic, side views illustrating an alternative process for cleaning an ink jet print head.

Referring to FIG. 8, an alternate maintenance cycle is shown. Referring to FIG. 8A, print assembly 140 contains print head 150. Fluid distribution device 500 is over wiper blade 520, mounted in wiper blade holder 810.

Figure 8B:
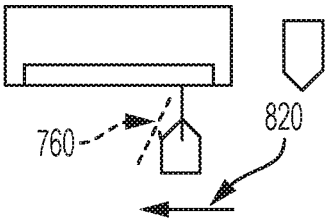

Referring to FIG. 8B, the print assembly 140 with print head 150 remains stationary as does fluid distribution device 500. The wiper blade holder 810 and wiper blade 520 are moved in the direction of arrow 820. Wiper blade 520 contacts the front face 410 of print head 150, providing a squeegee action. Ink and debris 760 are removed from the front face 410 by wiper blade 520.

The steps in a maintenance cycle, the timing as well as the various relative velocities, for example the relative velocity between the wiper assembly 320 and the ink jet print head 150 when the wiper blade 520 is in contact with the front face 410, can be controlled by the set of control electronics 180, as can the sequence of the steps. The sequence of the steps may be changed and still result in a cleaned print head 150 and wiper 320. The relative velocities may also be controlled mechanically, such as by a restriction used with a pneumatic or hydraulic cylinder.

A single wiper 320 may be used for a row of print heads 150 if the row contains more than one print head 150 used for a single color and the print heads 150 are aligned in the row such that one wiper 320 will contact the front faces 410 of all print heads 150 in the row.

The wiper 320 need not be vertical when cleaned. If printer 100 has more than one print head 150 and wiper 320, only wipers 320 that will contact front faces 410 may be cleaned in a maintenance cycle. That is, if a wiper 320 will not be used in a maintenance cycle, it may not be cleaned.

It is to be understood that the foregoing description is intended to illustrate and not to limit the scope of the invention, which is defined by the scope of the appended claims. Other embodiments are within the scope of the following claims.

What is claimed is:

1. A method of providing a maintenance cycle for an ink jet printer including a print assembly containing at least one print head and a wiper, the wiper configured to contact the print head when in a vertical position and to not contact the print head when in a tilted position the method comprising:

positioning the wiper between a printing position where the print head is disposed over substrate to be printed upon and a maintenance position of the print assembly where the print head is positioned away from the substrate;

attaching a fluid distribution device to the print assembly such that the fluid distribution device is disposed over the wiper when the print assembly is in the printing position and is moved away from the wiper when the print assembly in in the maintenance position;

providing a flushing fluid to be dispensed by the fluid distribution device onto the wiper to clean the wiper of excess ink and debris;

performing a wiper cleaning procedure when the print assembly is in the printing position, the wiper cleaning procedure including, pivoting the wiper about a pivot point to a vertical position when the print head is printing upon a substrate;

dispensing flushing fluid from the fluid distribution device onto the wiper to clean the wiper when then wiper is in the vertical position;

performing a maintenance procedure including, pivoting the wiper about the pivot point to a tilted position;

moving, with the wiper in the tilted position, the print assembly from the printing position to the maintenance position, wherein the wiper does not contact the print head as the print assembly moves from the printing position to the maintenance position;

purging ink from the print head;

pivoting, after purging ink from the print head, the wiper about the pivot point to a vertical position;

moving, with the wiper in the vertical position, the print assembly from the maintenance position to the printing position, the wiper contacting the print head as the print assembly moves from the maintenance position to the printing position and removing excess ink and debris from the print head.

2. The method of claim 1, wherein moving print assembly between the maintenance position and the printing position includes moving the print assembly substantially linearly along a first axis extending from the maintenance position to the printing position.

3. The method of claim 2 wherein the pivot point is disposed at a fixed distance from the first axis.

4. The method of claim 2, wherein the fluid distribution device is positioned to provide flushing fluid to the wiper along a second axis substantially transverse to the first axis when the print assembly is in the printing position.

5. The method of claim 1 wherein the fluid distribution device is configured to use gravity to dispense flushing fluid to the wiper.

6. The method of claim 1, further comprising dispensing flushing fluid from the fluid distribution device onto the wiper to clean the wiper twice before it contacts the print head.

7. The method of claim 1, wherein the dispensing of the flushing fluid from the fluid distribution device onto the wiper occurs before the wiper contacts the print head.

8. The method of claim 1, wherein the dispensing of the flushing fluid from the fluid distribution device onto the wiper occurs while the print head is printing on the substrate.

9. The method of claim 1 wherein the dispensing of the flushing fluid from the fluid distribution device onto the wiper rinses the wiper when the wiper is in the printing position.

10. The method of claim 1 wherein the dispensing of the flushing fluid from the fluid distribution device onto the wiper flows the flushing fluid over the wiper when the wiper is in the printing position.

11. The method of claim 10 wherein the wiper is configured such that the fluid and any debris on the wiper flows away from an edge of the wiper that contacts the print head when the print assembly moves between the maintenance position and the printing position.

12. The method of claim 1 wherein purging ink from the print head includes ejecting ink from the print head when the print head is in the maintenance position.

* * * * *